US007007801B2

(12) United States Patent
Mangold et al.

(10) Patent No.: US 7,007,801 B2
(45) Date of Patent: Mar. 7, 2006

(54) PACKAGING CONTAINER FOR MOIST CLOTHS OR MOIST COSMETIC PADS

(75) Inventors: Rainer Mangold, Herbrechtingen (DE); Angela Römpp, Zell u.A. (DE)

(73) Assignee: Paul-Hartmann AG, Heidenheim (DE)

( * ) Notice: Subject to any disclaimer, the term of this patent is extended or adjusted under 35 U.S.C. 154(b) by 98 days.

(21) Appl. No.: 10/492,321

(22) PCT Filed: Oct. 17, 2002

(86) PCT No.: PCT/EP02/11606

§ 371 (c)(1),
(2), (4) Date: Apr. 12, 2004

(87) PCT Pub. No.: WO03/037746

PCT Pub. Date: May 8, 2003

(65) Prior Publication Data

US 2004/0245139 A1 Dec. 9, 2004

(30) Foreign Application Priority Data

Oct. 30, 2001 (DE) ..... 101 53 426

(51) Int. Cl.
*B65D 73/00* (2006.01)

(52) U.S. Cl. ..... 206/494; 221/45

(58) Field of Classification Search ..... 206/205, 206/210, 233, 494, 499, 581, 812; 221/33, 221/45, 46, 63, 48–50
See application file for complete search history.

(56) References Cited

U.S. PATENT DOCUMENTS

| | | | | |
|---|---|---|---|---|
| 3,780,908 | A | 12/1973 | Fitzpatrick et al. | |
| 3,819,043 | A | 6/1974 | Harrison | |
| 4,420,080 | A * | 12/1983 | Nakamura | 206/494 |
| 4,840,270 | A | 6/1989 | Caputo et al. | |
| 5,688,394 | A * | 11/1997 | McBride et al. | 206/494 |
| 5,738,212 | A | 4/1998 | Pollard et al. | |
| 6,026,953 | A * | 2/2000 | Nakamura et al. | 206/494 |

FOREIGN PATENT DOCUMENTS

| | | |
|---|---|---|
| DE | 35 14943 | 10/1986 |
| EP | 1 000 872 | 11/1999 |
| EP | 1 136 412 | 9/2001 |
| EP | 1 188 404 | 3/2002 |
| FR | 2 443 981 | 7/1980 |

* cited by examiner

*Primary Examiner*—Luan K. Bui
(74) *Attorney, Agent, or Firm*—Young & Basile, P.C.

(57) ABSTRACT

A packaging container for accommodating at least two stacks of moist cloths or moist cosmetic pads. The moist cloths or moist cosmetic pads of different stacks overlap only in one partial area in such a manner that a moist cloth or cosmetic pad of one stack protrudes into the partial area while being situated between two moist cloths or cosmetic pads of the other stack. The packaging container has an external shape that corresponds to the external shape of the moist cloths or moist cosmetic pads located in overlapping areas while, however, deviating from the respective fundamental shape of the moist cloths or cosmetic pads. A removal opening is provided in a manual access area located on the overlapping area of the moist cloths or cosmetic pads.

17 Claims, 2 Drawing Sheets

Fig. 1
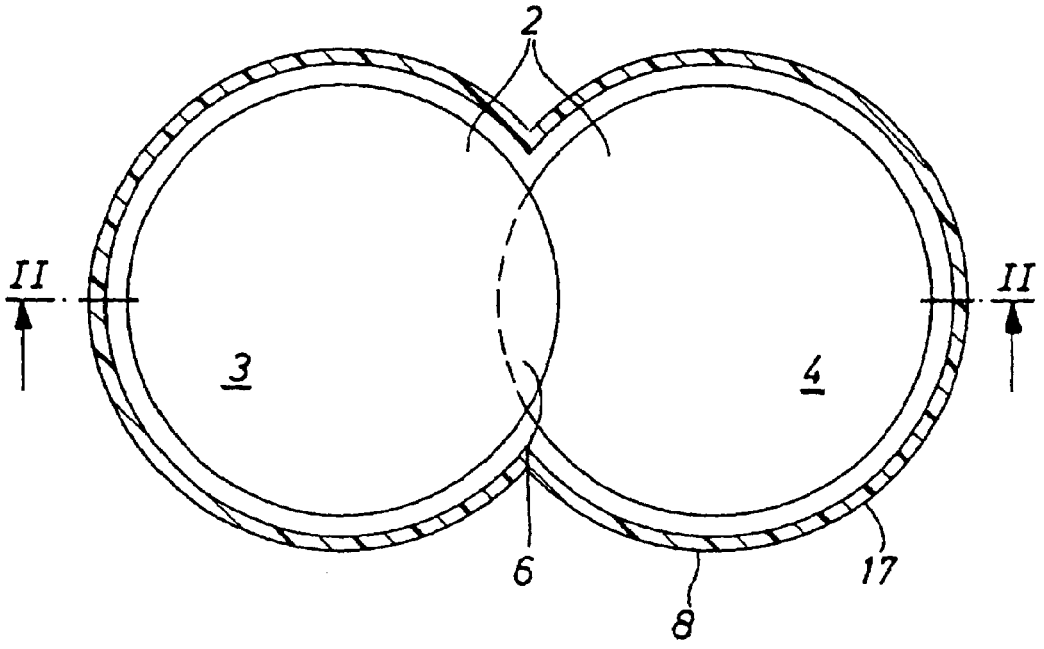
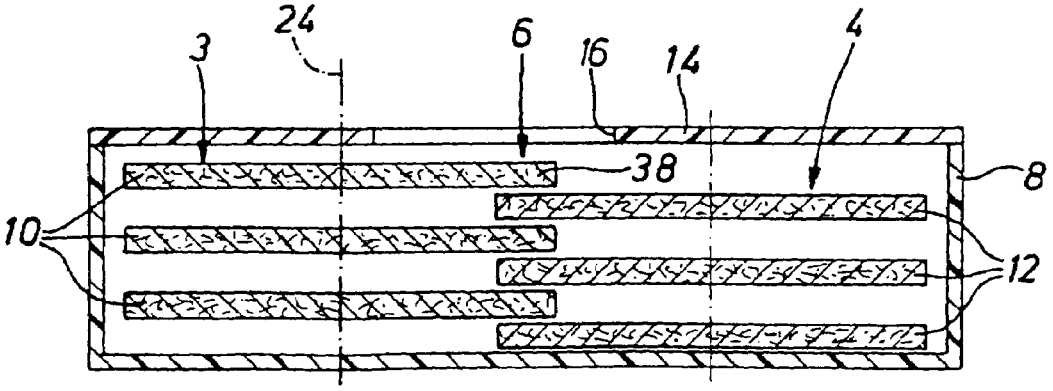
Fig. 2

Fig. 3
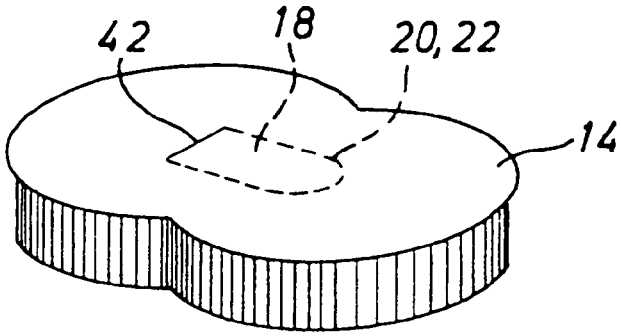
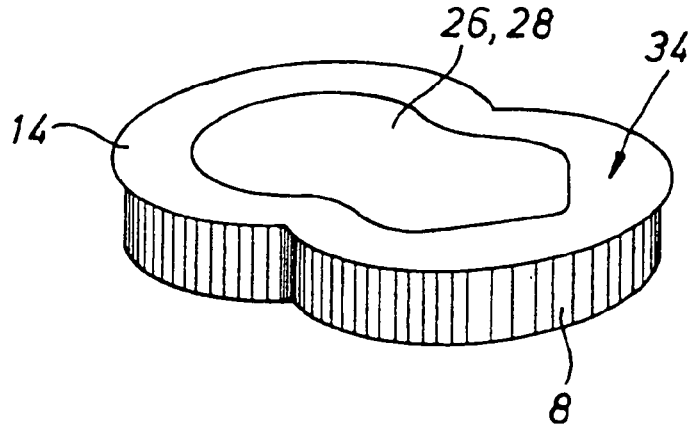
Fig. 4
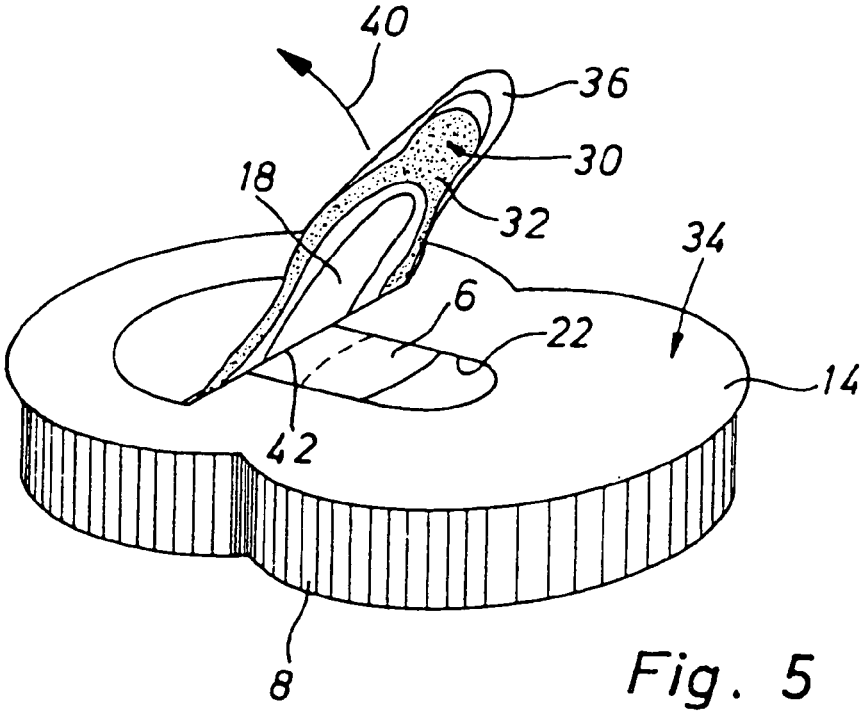
Fig. 5

PACKAGING CONTAINER FOR MOIST CLOTHS OR MOIST COSMETIC PADS

BACKGROUND

The invention relates to a packaging container for accommodating moist cloths or moist cosmetic pads.

Packaging containers for accommodating moist cloths or cosmetic pads are known in the art.

A packaging container for moist cloths which can be removed through a removal opening is known from EP 1 002 746 A1. The removal opening allows manual access to a central area of the moist cloths placed in the container.

From EP 0 857 453 A1, moist cloths are known which are prepared on at least one edge for gripping each moist cloth.

From EP 0 978 247 A1, stacks of moist cloths are known in which additional layers are placed to retain moisture.

There are also commercial packaging containers for moist cloths or cosmetic pads which consist of a base and a screw-top lid.

Common to the above-described publications is that the moist cloths or cosmetic pads are arranged in only one stack. To remove a moist cloth or cosmetic pad easily from the packaging container, either an opening must be uncovered which essentially matches the dimensions of the moist cloth or cosmetic pad, or access to a moist cloth or cosmetic pad is afforded in the center of the surface of the moist cloth or cosmetic pad, causing it to be deformed when gripped with the fingers and extracted through the removal opening, which has smaller dimensions than the moist cloth or cosmetic pad. A large opening has the disadvantage that the inserted cloths or pads quickly dry out when the opening is uncovered. For example, commercial packaging containers with a screw-top lid reveal a very large opening. Removing the screw-top lid is performed by unscrewing the lid, which necessitates gripping the screw-top lid and/or packaging container multiple times. Removal of a pad is inconvenient. In addition, a large removal opening is uncovered, thereby increasing the previously mentioned risk of the inserted cloths drying out. Inserting additional moisture retaining layers, as provided for in EP 0 978 247 A1, is complicated and increases the volume for disposal. The additional inserts further take up space which is then no longer available for the placement of cloths or pads.

The object of the present invention is to create a packaging container to accommodate moist cloths or cosmetic pads which allows convenient removal of a moist cloth or cosmetic pad and offers good protection to the inserted moist cloths or cosmetic pads against drying out and is simple and inexpensive to produce.

SUMMARY

This object is achieved with a packaging container to accommodate at least two stacks of moist cloths or moist cosmetic pads. The moist cloths or moist cosmetic pads of different stacks overlap in only a partial area such that between every two moist cloths or cosmetic pads of one stack a moist cloth or cosmetic pad from the other stack projects into the partial area. The packaging container has an exterior shape which corresponds to the outer shape of the moist cloths or moist cosmetic pads arranged to partially overlap, but which deviates from the specific basic shape of the moist cloths or cosmetic pads. A removal opening is furnished in the manual access area on the overlap area of the moist cloths or cosmetic pads.

BRIEF DESCRIPTION OF THE DRAWING

Additional advantageous aspect and details of the invention are found in the following description, in which the invention is described and explained in more detail with reference to the drawing.

FIG. 1 shows a plan view of a packaging container in accordance with the invention for moist cloths or moist cosmetic pads; and FIG. 2 is a cross-sectional view generally taken along line II—II in FIG. 1 and showing how the moist cloths or cosmetic pads overlap in one area;

FIG. 3 is a perspective view of the packing container base;

FIG. 4 is a perspective view of the packing container base with the removal opening completely covered by the closing means; and FIG. 5 is a perspective view of the packing container base showing a partially separated, detachable cut-out.

DETAILED DESCRIPTION

The cloths or pads 2 have an essentially circular shape. The moist cloths or cosmetic pads 2 are arranged in two stacks 3, 4. The moist cloths of the one stack overlap with those of the other stack. An overlap area 6 is created in which the stacks are interleaved with one another. The stacks 3 and 4 are accommodated in a packaging base 8 which has an exterior shape approximately in the form of a figure-8, which essentially matches the external shape of the two interleaved stacks 3 and 4.

Each cosmetic pad 10 of the one stack 3 protrudes between two cosmetic pads 12 of the other stack.

The packaging container in accordance with the invention serves to accommodate at least two stacks of moist cloths or moist cosmetic pads 2 having a basic shape which can be anything, for example, round, elliptical or polygonal. Through the overlapping of the cloths or pads 2 in only over a partial area, an exterior shape is created which deviates from the basic shapes of the cloths or pads 2. The exterior shape encloses the at least two stacks of moist cloths or cosmetic pads 2. The cloths or pads 2 are arranged such that they mutually overlap each other in alternation. In this area of overlap, the cloths or pads 2 can be gripped in turn at the edge of the one stack or of the other stack. For this purpose, a removal opening is furnished in the manual access area on this overlap area. The removal opening can be configured small compared with the basic shape of the cloths or pads 2 and still allow convenient removal of a cloth or pad. Because the exterior shape of the packaging container is conformed to the shapes of the cloths or pads 2, an aesthetically pleasing impression is conveyed.

The exterior shape of the packaging container is formed or determined by the two or more overlapping basic shapes. It is also conceivable that various basic shapes, for example, a circular shape and an angular shape are chosen. For aesthetic reasons, however, it proves favorable to choose basic shapes which have at least a similar configuration. It proves especially advantageous to choose basic shapes with a circular or oval surface. In this case, the packaging container has an exterior shape approximating a figure 8. This shape proves advantageous with respect to simple manufacture of the packaging container and to an aesthetic design of same.

It further proves to be advantageous if the removal opening is formed by an at least partially detachable cut-out in one wall of the packaging container.

Before the initial use of the packaging container, the inserted moist cloths or cosmetic pads 2 should be enclosed in an air-tight manner to the greatest degree possible. It proves advantageous if the removal opening is not formed until the first time a moist cloth or cosmetic pad 2 is removed. To this end, the detachable cut-out advantageously has a weakening line at least along one part of its periphery.

The weakening line is advantageously formed as a perforation in one wall of the packaging container. It is then possible to detach the cut-out conveniently without the need for additional tools. A perforation is also simple to produce.

In accordance with a further aspect of the invention, it proves advantageous if a reusable closing means is employed which either uncovers the removal opening or seals it in an essentially air-tight manner.

Closing means of this kind can be configured, for example, as a sealing or adhesive film which overlays the removal opening on all sides and, at least outside the removal opening, is furnished with a pressure-sensitive adhesive with which the closing means is detachably attached to one wall of the packaging container, thereby closing the removal opening in an essentially air-tight manner.

In a further development of the inventive concept, it is proposed that the closing means is non-detachably bonded to a cut-out in one wall of the packaging container and that by detaching the closing means for the first time to create the removal opening, the cut-out, which is non-detachably bonded to the closing means, is separated at least partially from the wall of the packaging container. At the time of initial use, the cut-out is at least partially separated from the wall of the packaging container. However, the cut-out remains attached to the closing means. No additional handling procedure to separate the cut-out from the wall of the packaging container is necessary, rather this happens by peeling back or pivoting the closing means. It is also not necessary to dispose of the wall cut-out separately.

The packaging container preferably consists of a base forming an accommodation space and a cover.

When the packaging container is filled, the moist cloths or cosmetic pads 2 can be inserted into the accommodation space and then a cover can be applied to the container base.

The cover can consist, for example, of a film which is bonded along its edge to the edge of the container base. The bonding can be accomplished by adhesion or welding.

The removal opening is then created advantageously in the cover of the packaging container.

It further proves advantageous if the packaging container or its packaging base and/or its cover is formed of a synthetic material. Bulk plastics, such as polyethylene, polypropylene or polystyrene, for example, are suitable for the manufacture of the packaging components. These materials are light, inexpensive and allow the packaging components to be freely designed. The plastics used can be transparent or color-impregnated and have suitable decoration on the exterior or interior. It proves particularly advantageous for low-priced manufacture of the packaging container that the packaging container is formed as a deep-draw part. It is possible to manufacture the packaging container possessing adequate strength and good surface quality, combined with a thin wall thickness and low material consumption. Material wall thicknesses of the deep-draw film advantageously measure 400 to 800 $\mu$m.

The pads or cosmetic cloths 2 to be placed in the packaging container consist preferably of cotton or viscose nonwoven material, where synthetic fibers, preferably bicomponent fibers and/or PES fibers of 1 to 10 denier and with a length of 3 to 60 mm, can be added as necessary. An admixture of PES microfibers of 0.1 to 0.9 denier is also conceivable. The pads 2 or cloths are manufactured using conventional nonwoven techniques, such as air-laying, carding, needling, or water-jet needling and bonded as required with thermal or chemical binders. The base weight of the pads 2 or cloths in a dry state is between 40 and 300 g/m$^2$, preferably between 60 and 150 g/m$^2$, specifically between 70 and 90 g/m$^2$.

When filling the packaging container, the pads 2 are inserted into the packaging base in a dry state. After two to five pads 2 have been inserted, a cleaning fluid is applied using a metering pump. This fluid can consist, for example, of an aqueous solution or an oil-in-water emulsion or a water-in-oil emulsion. The fluid can contain additional skin-care components, for example, plant extracts, such as aloe vera, and/or fragrances, perfumes and/or preservatives. A pad 2 absorbs between 0.5 and 6 grams, preferably between 1.5 and 3 grams of fluid, with about 60 to 90% of the total weight of a pad coming from its fluid content. For example, an oval cotton pad 2 with diameters of 70 and 90 mm weighs about 0.4 grams, 2.5 grams after the application of the cleaning fluid, with the weight of the fluid making up 84%. With circular or oval pads 2, the small diameter is specifically 30–110 mm and the large diameter is 30–220 mm. Preferably the diameters are 60–80 mm and 70–110 mm respectively.

A packaging base 8 which surrounds the two stacks 3, 4 has a cover 14 with a removal opening 16. The cover 14 is configured as a film and welded to the packaging base 8 along a collar-shaped edge area 17 rolled over to the outside.

The packaging base 8 is shown in FIG. 3 with the cover 14 attached thereto, which has a detachable cut-out 18 approximately in the center bounded along its periphery by a weakening line 20 in the form of a perforation 22. This detachable cut-out 18 forms the removal opening 16 which is furnished above the overlap area 6 in the direction of the stack 24 (FIG. 1).

FIG. 4 shows the packaging container in accordance with FIG. 3, where the removal opening 16, or the cut-out 18, is completely covered by closing means 26 in the form of a tab 28 completely overlaying the cut-out 18. The tab 28 has a pressure-sensitive adhesive coating 32 on the side 30 facing the cover 14. It is non-detachably connected to the cut-out 18 and detachably adheres to the outward facing visible side 34 of the cover. The tab 28 comprises a gripping area 36 at one longitudinal end, which is free of adhesive and serves as a "finger lift."

To open the packaging container, a user takes hold of the tab 28 with his fingers in the gripping area 36 and then peels the tab 28 upward or to the rear. The cut-out 18, which is detachable from the wall of the cover 14, is disengaged from the cover 14 along its perforation 22 together with the tab 28, and the removal opening is thereby created. A user now has access to the overlap area 6 of the moist cloths or moist cosmetic pads 2 and can take hold of the topmost cosmetic pad 2 with his fingers at its edge (see FIG. 2) and remove it from the packaging container through the removal opening 36. The tab 28 is then replaced on the visible side of the cover and pressed against it using the fingers, so that by means of the pressure-sensitive adhesive coating 32 the packaging container is closed again in an essentially air-tight manner.

As can seen from FIG. 5, it is not necessary to separate the tab 28 completely from the cover 14. The detachable cut-out 18 is configured as an elongated aperture, and it suffices to peel back the closure tab 28 partially from the visible side 30 to create a removal opening 16 which is large enough to remove a particular moist cloth or cosmetic pad 2 from the packaging container. This proves particularly advantageous since the correct position of the tab 28 is retained with respect to the removal opening 16 so formed, and the tab 28 can be again brought to its correct closing position. To prevent the tab 28 from being peeled back too far, it proves to be particularly beneficial if the cut-out 18 is not surrounded completely by the perforation 22; but remains attached to the cover 14 along a line 42 running preferably essentially perpendicular to the direction of the opening 40.

What is claimed is:

1. Packaging container to accommodate at least two stacks (3, 4) of moist cloths or moist cosmetic pads (2, 10, 12), characterized in that the moist cloths or moist cosmetic pads (10, 12) of different stacks (3, 4) overlap only in a partial area (6), such that between every two moist cloths or cosmetic pads (12) of one stack (4) a moist cloth or moist cosmetic pad (1) of the other stack (3) projects into the partial area (6) and that the packaging container has an exterior shape which corresponds to the outer shape of the moist cloths or moist cosmetic pads (2, 10, 12) arranged to partially overlap, but which deviates from the particular basic shape of the moist cloths or cosmetic pads (2, 10, 12), and that a removal opening (16) is furnished in the manual access area over the overlap area (6) of the moist cloths or cosmetic pads (2, 10, 12).

2. Packaging container in accordance with claim 1, wherein an exterior shape approximates a figure 8.

3. Packaging container in accordance with claim 1 or 2, wherein the removal opening (16) is formed by an at least partially detachable cut-out (18) in one wall of the packaging container.

4. Packaging container in accordance with claim 3, wherein the detachable cut-out (18) has a weakening line (20) at least along one part of its periphery.

5. Packaging container in accordance with claim 4, wherein the weakening line (20) is formed by a perforation (22).

6. Packaging container in accordance with at least one of the preceding claims, wherein a reusable closing means (26) is furnished which either uncovers the removal opening (6) or closes it in an essentially air-tight manner.

7. Packaging container in accordance with claim 6, wherein the closing means (26) is connected non-detachably to a cut-out in one wall of the packaging container, and when the closing means (26) is released for the first time to create the removal opening (16), the cut-out non-detachably connected to the closing means (26) can be separated at least partially from the wall of the packaging container.

8. Packaging container in accordance with at least one of the preceding claims, wherein the packaging container has a packaging base (8) forming an accommodation space and a cover (14).

9. Packaging container in accordance with claim 8, wherein the removal opening (16) is formed in the cover (14).

10. Packaging container in accordance with at least one of the preceding claims, wherein the packaging container or its base (8) and/or its cover (14) are made of a synthetic material.

11. Packaging container in accordance with at least one of the claims 8 to 10, wherein the packaging base (8) is configured as a deep-draw part.

12. Packaging container in accordance with claim 11, wherein the deep-draw part has a wall thickness of 400–800 $\mu$m.

13. Packaging container in accordance with at least one of the preceding claims, wherein the packaging container has an outside dimension in a longitudinal direction of 75 to 135 mm, and/or an outside dimension in a transverse direction of 65 to 110 mm and/or a height of 15 to 40 mm.

14. Packaging container in accordance with at least one of the preceding claims, wherein the packaging container has an outside dimension in a waist area of 50 to 85 mm.

15. Packaging container in accordance with at least one of the claims 6 to 14, wherein the closing means (36) has a longitudinal extent of 60 to 110 mm and a transverse extent of 30–65 mm.

16. Packaging container in accordance with at least one of the preceding claims, wherein the removal opening (16) has a longitudinal extent of 40 to 60 mm and a transverse extent of 20 to 30 mm.

17. Packaging container in accordance with at least one of the preceding claims, wherein the amount of fluid for a moist cloth or cosmetic pad measures 60 to 90% by weight.

* * * * *

UNITED STATES PATENT AND TRADEMARK OFFICE

CERTIFICATE OF CORRECTION

PATENT NO. : 7,007,801 B2
APPLICATION NO. : 10/492321
DATED : March 7, 2006
INVENTOR(S) : Mangold et al.

It is certified that error appears in the above-identified patent and that said Letters Patent is hereby corrected as shown below:

PLEASE DELETE THE ENTIRE PATENTS TITLE PAGE, DRAWINGS AND COLUMNS 1 LINE 1 THROUGH COLUMNS 6 LINES 43 AND INSERT THE ATTACHED PATENTS TITLE PAGE, DRAWINGS AND COLUMNS 1 LINE 1 THROUGH COLUMNS 6 LINES 35 AS ATTACHED.

Signed and Sealed this

Ninth Day of June, 2009

JOHN DOLL
*Acting Director of the United States Patent and Trademark Office*

(12) United States Patent
Mangold et al.

(10) Patent No.: US 7,007,801 B2
(45) Date of Patent: Mar. 7, 2006

(54) PACKAGING CONTAINER FOR MOIST CLOTHS OR MOIST COSMETIC PADS

(75) Inventors: Rainer Mangold, Herbrechtingen (DE); Angela Römpp, Zell u.A. (DE)

(73) Assignee: Paul-Hartmann AG, Heidenheim (DE)

( * ) Notice: Subject to any disclaimer, the term of this patent is extended or adjusted under 35 U.S.C. 154(b) by 98 days.

(21) Appl. No.: 10/492,321

(22) PCT Filed: Oct. 17, 2002

(86) PCT No.: PCT/EP02/11606

§ 371 (c)(1),
(2), (4) Date: Apr. 12, 2004

(87) PCT Pub. No.: WO03/037746

PCT Pub. Date: May 8, 2003

(65) Prior Publication Data

US 2004/0245139 A1 Dec. 9, 2004

(30) Foreign Application Priority Data

Oct. 30, 2001 (DE) ..... 101 53 426

(51) Int. Cl.
*B65D 73/00* (2006.01)

(52) U.S. Cl. ..... 206/494; 221/45

(58) Field of Classification Search ..... 206/205, 206/210, 233, 494, 499, 581, 812; 221/33, 221/45, 46, 63, 48–50

See application file for complete search history.

(56) References Cited

U.S. PATENT DOCUMENTS

| | | | | |
|---|---|---|---|---|
| 3,780,908 | A | 12/1973 | Fitzpatrick et al. | |
| 3,819,043 | A | 6/1974 | Harrison | |
| 4,420,080 | A * | 12/1983 | Nakamura | 206/494 |
| 4,840,270 | A | 6/1989 | Caputo et al. | |
| 5,688,394 | A * | 11/1997 | McBride et al. | 206/494 |
| 5,738,212 | A | 4/1998 | Pollard et al. | |
| 6,026,953 | A * | 2/2000 | Nakamura et al. | 206/494 |

FOREIGN PATENT DOCUMENTS

| | | |
|---|---|---|
| DE | 35 14943 | 10/1986 |
| EP | 1 000 872 | 11/1999 |
| EP | 1 136 412 | 9/2001 |
| EP | 1 188 404 | 3/2002 |
| FR | 2 443 981 | 7/1980 |

* cited by examiner

*Primary Examiner*—Luan K. Bui
(74) *Attorney, Agent, or Firm*—Young & Basile, P.C.

(57) ABSTRACT

A packaging container for accommodating at least two stacks of moist cloths or moist cosmetic pads. The moist cloths or moist cosmetic pads of different stacks overlap only in one partial area in such a manner that a moist cloth or cosmetic pad of one stack protrudes into the partial area while being situated between two moist cloths or cosmetic pads of the other stack. The packaging container has an external shape that corresponds to the external shape of the moist cloths or moist cosmetic pads located in overlapping areas while, however, deviating from the respective fundamental shape of the moist cloths or cosmetic pads. A removal opening is provided in a manual access area located on the overlapping area of the moist cloths or cosmetic pads.

17 Claims, 2 Drawing Sheets

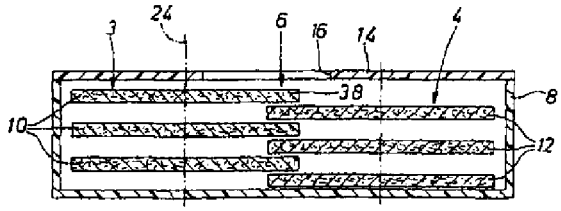

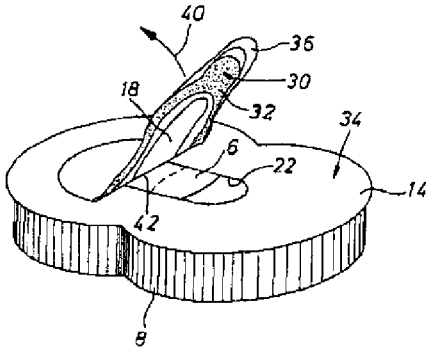

Fig. 1
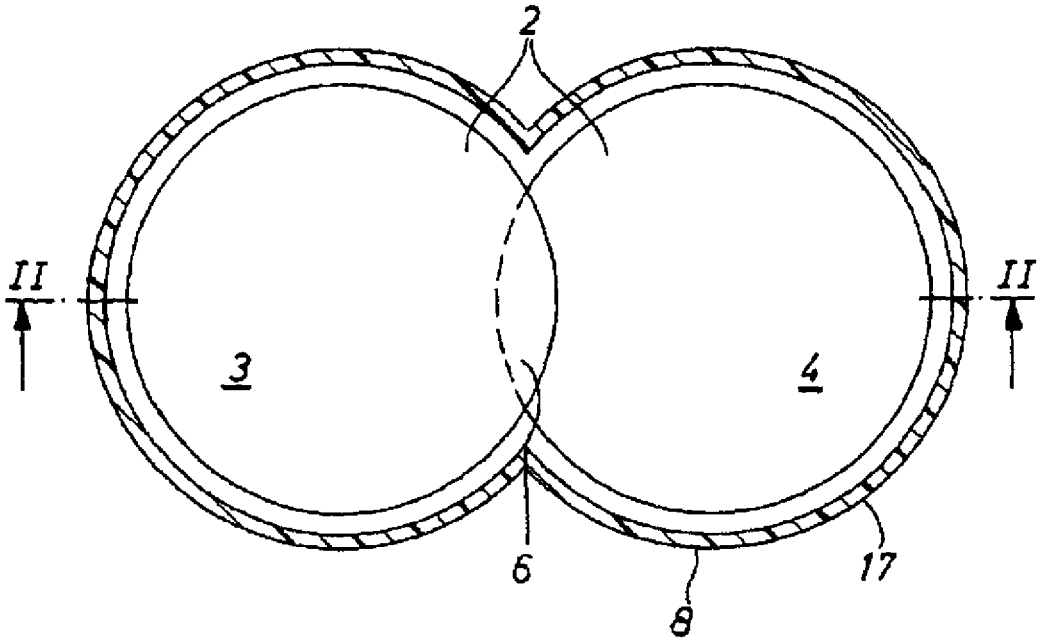
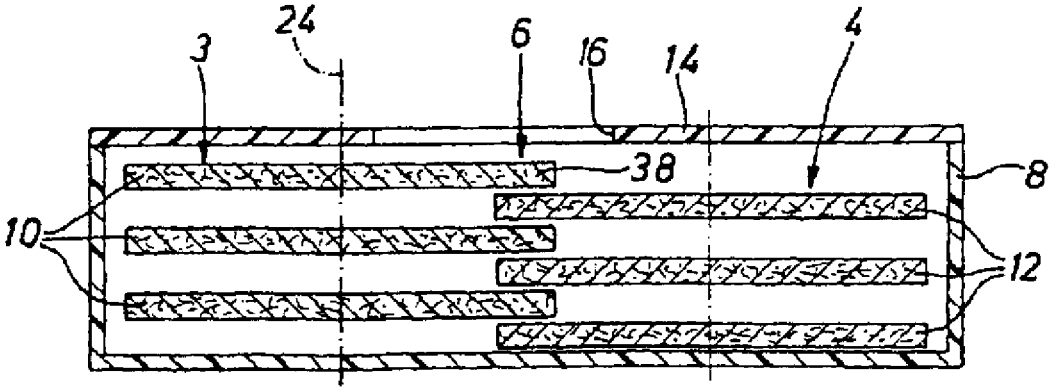
Fig. 2

Fig. 3
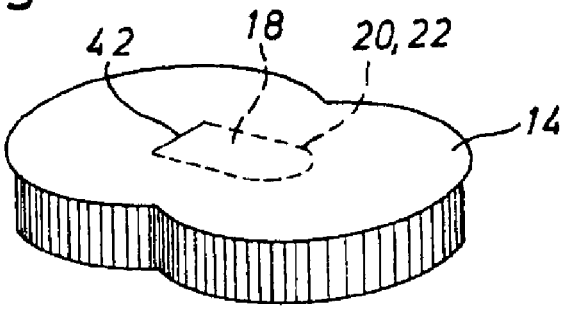
Fig. 4
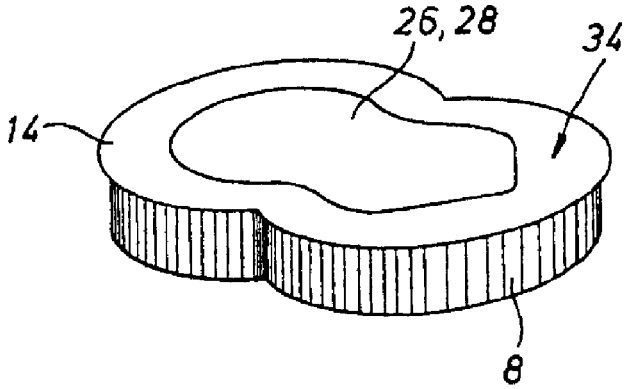
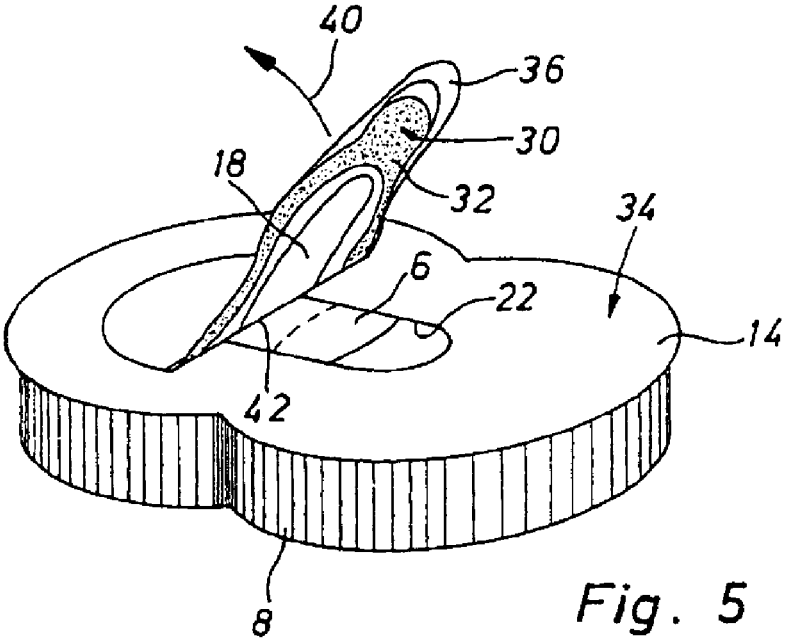
Fig. 5

PACKAGING CONTAINER FOR MOIST CLOTHS OR MOIST COSMETIC PADS

BACKGROUND

The invention relates to a packaging container for accommodating moist cloths or moist cosmetic pads.

Packaging containers for accommodating moist cloths or cosmetic pads are known in the art.

A packaging container for moist cloths which can be removed through a removal opening is known from EP 1 002 746 A1. The removal opening allows manual access to a central area of the moist cloths placed in the container.

From EP 0 857 453 A1, moist cloths are known which are prepared on at least one edge for gripping each moist cloth.

From EP 0 978 247 A1, stacks of moist cloths are known in which additional layers are placed to retain moisture.

There are also commercial packaging containers for moist cloths or cosmetic pads which consist of a base and a screw-top lid.

Common to the above-described publications is that the moist cloths or cosmetic pads are arranged in only one stack. To remove a moist cloth or cosmetic pad easily from the packaging container, either an opening must be uncovered which essentially matches the dimensions of the moist cloth or cosmetic pad, or access to a moist cloth or cosmetic pad is afforded in the center of the surface of the moist cloth or cosmetic pad, causing it to be deformed when gripped with the fingers and extracted through the removal opening, which has smaller dimensions than the moist cloth or cosmetic pad. A large opening has the disadvantage that the inserted cloths or pads quickly dry out when the opening is uncovered. For example, commercial packaging containers with a screw-top lid reveal a very large opening. Removing the screw-top lid is performed by unscrewing the lid, which necessitates gripping the screw-top lid and/or packaging container multiple times. Removal of a pad is inconvenient. In addition, a large removal opening is uncovered, thereby increasing the previously mentioned risk of the inserted cloths drying out. Inserting additional moisture retaining layers, as provided for in EP 0 978 247 A1, is complicated and increases the volume for disposal. The additional inserts further take up space which is then no longer available for the placement of cloths or pads.

The object of the present invention is to create a packaging container to accommodate moist cloths or cosmetic pads which allows convenient removal of a moist cloth or cosmetic pad and offers good protection to the inserted moist cloths or cosmetic pads against drying out and is simple and inexpensive to produce.

SUMMARY

This object is achieved with a packaging container to accommodate at least two stacks of moist cloths or moist cosmetic pads. The moist cloths or moist cosmetic pads of different stacks overlap in only a partial area such that between every two moist cloths or cosmetic pads of one stack a moist cloth or cosmetic pad from the other stack projects into the partial area. The packaging container has an exterior shape which corresponds to the outer shape of the moist cloths or moist cosmetic pads arranged to partially overlap, but which deviates from the specific basic shape of the moist cloths or cosmetic pads. A removal opening is furnished in the manual access area on the overlap area of the moist cloths or cosmetic pads.

BRIEF DESCRIPTION OF THE DRAWING

Additional advantageous aspect and details of the invention are found in the following description, in which the invention is described and explained in more detail with reference to the drawing.

FIG. 1 shows a plan view of a packaging container in accordance with the invention for moist cloths or moist cosmetic pads; and FIG. 2 is a cross-sectional view generally taken along line II—II in FIG. 1 and showing how the moist cloths or cosmetic pads overlap in one area;

FIG. 3 is a perspective view of the packing container base;

FIG. 4 is a perspective view of the packing container base with the removal opening completely covered by the closing means; and FIG. 5 is a perspective view of the packing container base showing a partially separated, detachable cut-out.

DETAILED DESCRIPTION

The cloths or pads 2 have an essentially circular shape. The moist cloths or cosmetic pads 2 are arranged in two stacks 3, 4. The moist cloths of the one stack overlap with those of the other stack. An overlap area 6 is created in which the stacks are interleaved with one another. The stacks 3 and 4 are accommodated in a packaging base 8 which has an exterior shape approximately in the form of a figure-8, which essentially matches the external shape of the two interleaved stacks 3 and 4.

Each cosmetic pad 10 of the one stack 3 protrudes between two cosmetic pads 12 of the other stack.

The packaging container in accordance with the invention serves to accommodate at least two stacks of moist cloths or moist cosmetic pads 2 having a basic shape which can be anything, for example, round, elliptical or polygonal. Through the overlapping of the cloths or pads 2 in only over a partial area, an exterior shape is created which deviates from the basic shapes of the cloths or pads 2. The exterior shape encloses the at least two stacks of moist cloths or cosmetic pads 2. The cloths or pads 2 are arranged such that they mutually overlap each other in alternation. In this area of overlap, the cloths or pads 2 can be gripped in turn at the edge of the one stack or of the other stack. For this purpose, a removal opening is furnished in the manual access area on this overlap area. The removal opening can be configured small compared with the basic shape of the cloths or pads 2 and still allow convenient removal of a cloth or pad. Because the exterior shape of the packaging container is conformed to the shapes of the cloths or pads 2, an aesthetically pleasing impression is conveyed.

The exterior shape of the packaging container is formed or determined by the two or more overlapping basic shapes. It is also conceivable that various basic shapes, for example, a circular shape and an angular shape are chosen. For aesthetic reasons, however, it proves favorable to choose basic shapes which have at least a similar configuration. It proves especially advantageous to choose basic shapes with a circular or oval surface. In this case, the packaging container has an exterior shape approximating a figure 8. This shape proves advantageous with respect to simple manufacture of the packaging container and to an aesthetic design of same.

It further proves to be advantageous if the removal opening is formed by an at least partially detachable cut-out in one wall of the packaging container.

Before the initial use of the packaging container, the inserted moist cloths or cosmetic pads 2 should be enclosed in an air-tight manner to the greatest degree possible. It proves advantageous if the removal opening is not formed until the first time a moist cloth or cosmetic pad 2 is removed. To this end, the detachable cut-out advantageously has a weakening line at least along one part of its periphery.

The weakening line is advantageously formed as a perforation in one wall of the packaging container. It is then possible to detach the cut-out conveniently without the need for additional tools. A perforation is also simple to produce.

In accordance with a further aspect of the invention, it proves advantageous if a reusable closing means is employed which either uncovers the removal opening or seals it in an essentially air-tight manner.

Closing means of this kind can be configured, for example, as a sealing or adhesive film which overlays the removal opening on all sides and, at least outside the removal opening, is furnished with a pressure-sensitive adhesive with which the closing means is detachably attached to one wall of the packaging container, thereby closing the removal opening in an essentially air-tight manner.

In a further development of the inventive concept, it is proposed that the closing means is non-detachably bonded to a cut-out in one wall of the packaging container and that by detaching the closing means for the first time to create the removal opening, the cut-out, which is non-detachably bonded to the closing means, is separated at least partially from the wall of the packaging container. At the time of initial use, the cut-out is at least partially separated from the wall of the packaging container. However, the cut-out remains attached to the closing means. No additional handling procedure to separate the cut-out from the wall of the packaging container is necessary, rather this happens by peeling back or pivoting the closing means. It is also not necessary to dispose of the wall cut-out separately.

The packaging container preferably consists of a base forming an accommodation space and a cover.

When the packaging container is filled, the moist cloths or cosmetic pads 2 can be inserted into the accommodation space and then a cover can be applied to the container base.

The cover can consist, for example, of a film which is bonded along its edge to the edge of the container base. The bonding can be accomplished by adhesion or welding.

The removal opening is then created advantageously in the cover of the packaging container.

It further proves advantageous if the packaging container or its packaging base and/or its cover is formed of a synthetic material. Bulk plastics, such as polyethylene, polypropylene or polystyrene, for example, are suitable for the manufacture of the packaging components. These materials are light, inexpensive and allow the packaging components to be freely designed. The plastics used can be transparent or color-impregnated and have suitable decoration on the exterior or interior. It proves particularly advantageous for low-priced manufacture of the packaging container that the packaging container is formed as a deep-draw part. It is possible to manufacture the packaging container possessing adequate strength and good surface quality, combined with a thin wall thickness and low material consumption. Material wall thicknesses of the deep-draw film advantageously measure 400 to 800 μm.

The pads or cosmetic cloths 2 to be placed in the packaging container consist preferably of cotton or viscose nonwoven material, where synthetic fibers, preferably bi-component fibers and/or PES fibers of 1 to 10 denier and with a length of 3 to 60 mm, can be added as necessary. An admixture of PES microfibers of 0.1 to 0.9 denier is also conceivable. The pads 2 or cloths are manufactured using conventional nonwoven techniques, such as air-laying, carding, needling, or water-jet needling and bonded as required with thermal or chemical binders. The base weight of the pads 2 or cloths in a dry state is between 40 and 300 g/m$^2$, preferably between 60 and 150 g/m$^2$, specifically between 70 and 90 g/m$^2$.

When filling the packaging container, the pads 2 are inserted into the packaging base in a dry state. After two to five pads 2 have been inserted, a cleaning fluid is applied using a metering pump. This fluid can consist, for example, of an aqueous solution or an oil-in-water emulsion or a water-in-oil emulsion. The fluid can contain additional skin-care components, for example, plant extracts, such as aloe vera, and/or fragrances, perfumes and/or preservatives. A pad 2 absorbs between 0.5 and 6 grams, preferably between 1.5 and 3 grams of fluid, with about 60 to 90% of the total weight of a pad coming from its fluid content. For example, an oval cotton pad 2 with diameters of 70 and 90 mm weighs about 0.4 grams, 2.5 grams after the application of the cleaning fluid, with the weight of the fluid making up 84%. With circular or oval pads 2, the small diameter is specifically 30–110 mm and the large diameter is 30–220 mm. Preferably the diameters are 60–80 mm and 70–110 mm respectively.

A packaging base 8 which surrounds the two stacks 3, 4 has a cover 14 with a removal opening 16. The cover 14 is configured as a film and welded to the packaging base 8 along a collar-shaped edge area 17 rolled over to the outside.

The packaging base 8 is shown in FIG. 3 with the cover 14 attached thereto, which has a detachable cut-out 18 approximately in the center bounded along its periphery by a weakening line 20 in the form of a perforation 22. This detachable cut-out 18 forms the removal opening 16 which is furnished above the overlap area 6 in the direction of the stack 24 (FIG. 1).

FIG. 4 shows the packaging container in accordance with FIG. 3, where the removal opening 16, or the cut-out 18, is completely covered by closing means 26 in the form of a tab 28 completely overlaying the cut-out 18. The tab 28 has a pressure-sensitive adhesive coating 32 on the side 30 facing the cover 14. It is non-detachably connected to the cut-out 18 and detachably adheres to the outward facing visible side 34 of the cover. The tab 28 comprises a gripping area 36 at one longitudinal end, which is free of adhesive and serves as a "finger lift."

To open the packaging container, a user takes hold of the tab 28 with his fingers in the gripping area 36 and then peels the tab 28 upward or to the rear. The cut-out 18, which is detachable from the wall of the cover 14, is disengaged from the cover 14 along its perforation 22 together with the tab 28, and the removal opening is thereby created. A user now has access to the overlap area 6 of the moist cloths or moist cosmetic pads 2 and can take hold of the topmost cosmetic pad 2 with his fingers at its edge (see FIG. 2) and remove it from the packaging container through the removal opening 36. The tab 28 is then replaced on the visible side of the cover and pressed against it using the fingers, so that by means of the pressure-sensitive adhesive coating 32 the packaging container is closed again in an essentially air-tight manner.

As can seen from FIG. 5, it is not necessary to separate the tab 28 completely from the cover 14. The detachable cut-out 18 is configured as an elongated aperture, and it suffices to peel back the closure tab 28 partially from the visible side 30 to create a removal opening 16 which is large enough to remove a particular moist cloth or cosmetic pad 2 from the packaging container. This proves particularly advantageous since the correct position of the tab 28 is retained with respect to the removal opening 16 so formed, and the tab 28 can be again brought to its correct closing position. To prevent the tab 28 from being peeled back too far, it proves to be particularly beneficial if the cut-out 18 is not surrounded completely by the perforation 22; but remains attached to the cover 14 along a line 42 running preferably essentially perpendicular to the direction of the opening 40.

What is claimed is:

1. A packaging container to accommodate at least two stacks of moist elements, characterized in that the moist elements of different stacks overlap only in a partial area, such that between every two moist elements of one stack, a moist element of the other stack projects into the partial area and that the packaging container has an exterior shape which corresponds to the outer shape of the moist elements arranged to partially overlap, but which deviates from the basic shape of the moist elements, and that a removal opening is furnished in a manual access area over the overlap area of the moist elements.

2. The packaging container in accordance with claim 1, wherein an exterior shape of the packaging container approximates a figure eight.

3. The packaging container in accordance with claim 1, wherein the removal opening is formed by an at least partially detachable cut-out in one wall of the packaging container.

4. The packaging container in accordance with claim 3, wherein the detachable cut-out has a weakening line at least along one part of its periphery.

5. The packaging container in accordance with claim 4, wherein the weakening line is formed by a perforation.

6. The packaging container in accordance with claim 1, wherein a reusable closing means is furnished which uncovers at least one of the removal opening and closes the removal opening in an essentially air-tight manner.

7. The packaging container in accordance with claim 6, wherein the closing means is non-detachably connected to a cut-out in one wall of the packaging container, and when the closing means is released for the first time to create the removal opening, the cut-out being non-detachably connected to the closing means to be at least partially separated from the wall of the packaging container.

8. The packaging container in accordance with claim 1, wherein the packaging container has a packaging base forming an accommodation space, and a cover.

9. The packaging container in accordance with claim 8, wherein the removal opening is formed in the cover.

10. The packaging container in accordance with claim 8, wherein at least one of the packaging container and the base and the cover are made of a synthetic material.

11. The packaging container in accordance with claim 8, wherein the packaging base is configured as a deep-draw part.

12. The packaging container in accordance with claim 11, wherein the deep-draw part has a wall thickness of about 400–800 μm.

13. The packaging container in accordance with claim 1, wherein the packaging container has an outside dimension in a longitudinal direction of 75 to 135 mm, and an outside dimension in a transverse direction of 65 to 110 mm and a height of 15 to 40 mm.

14. The packaging container in accordance with claim 1, wherein the packaging container has an outside dimension in a waist area of 50 to 85 mm.

15. The packaging container in accordance with claim 6 wherein the closing means has a longitudinal extent of 60 to 110 mm and a transverse extent of 30–65 mm.

16. The packaging container in accordance with claim 1, wherein the removal opening has a longitudinal extent of 40 to 60 mm and a transverse extent of 20 to 30 mm.

17. The packaging container in accordance with claim 7, wherein an amount of fluid added to each moist element measures 60% to 90% by weight.

* * * * *